US006578479B2

(12) United States Patent
Schramm

(10) Patent No.: US 6,578,479 B2
(45) Date of Patent: Jun. 17, 2003

(54) METHOD OF OPERATING A WEB-FED ROTARY PRINTING MACHINE

(75) Inventor: Michael Schramm, Aindling-Gaulzhofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 129 days.

(21) Appl. No.: 09/815,694

(22) Filed: Mar. 23, 2001

(65) Prior Publication Data

US 2001/0027731 A1 Oct. 11, 2001

(30) Foreign Application Priority Data

Mar. 23, 2000 (DE) ..... 100 14 535

(51) Int. Cl.[7] ..... B41F 13/02; B41F 5/04

(52) U.S. Cl. ..... 101/219; 101/DIG. 42; 226/111

(58) Field of Search ..... 101/219, DIG. 42; 226/777, 42

(56) References Cited

U.S. PATENT DOCUMENTS

| | | | | | |
|---|---|---|---|---|---|
| 5,269,222 | A | * | 12/1993 | Johnson et al. | 101/228 |
| 5,937,756 | A | * | 8/1999 | Kishine et al. | 101/181 |
| 6,085,956 | A | * | 7/2000 | Sainio et al. | 226/4 |
| 6,106,177 | A | * | 8/2000 | Siegl et al. | 101/228 |
| 6,213,367 | B1 | * | 4/2001 | Flamm | 226/42 |

* cited by examiner

*Primary Examiner*—Andrew H. Hirshfeld
*Assistant Examiner*—Leo T. Hinze
(74) *Attorney, Agent, or Firm*—Cohen, Pontani, Lieberman & Pavane

(57) ABSTRACT

In order to reach optimal web tension relationships rapidly in the folder superstructure when starting up a web-fed rotary printing machine, first of all a web is transported with the print in the printing units thrown off, the pull units lying on the web path being operated with first lead values for optimal web tensions and, after printing has been thrown on, the pull units being operated with second lead values for optimal web tensions.

8 Claims, 1 Drawing Sheet

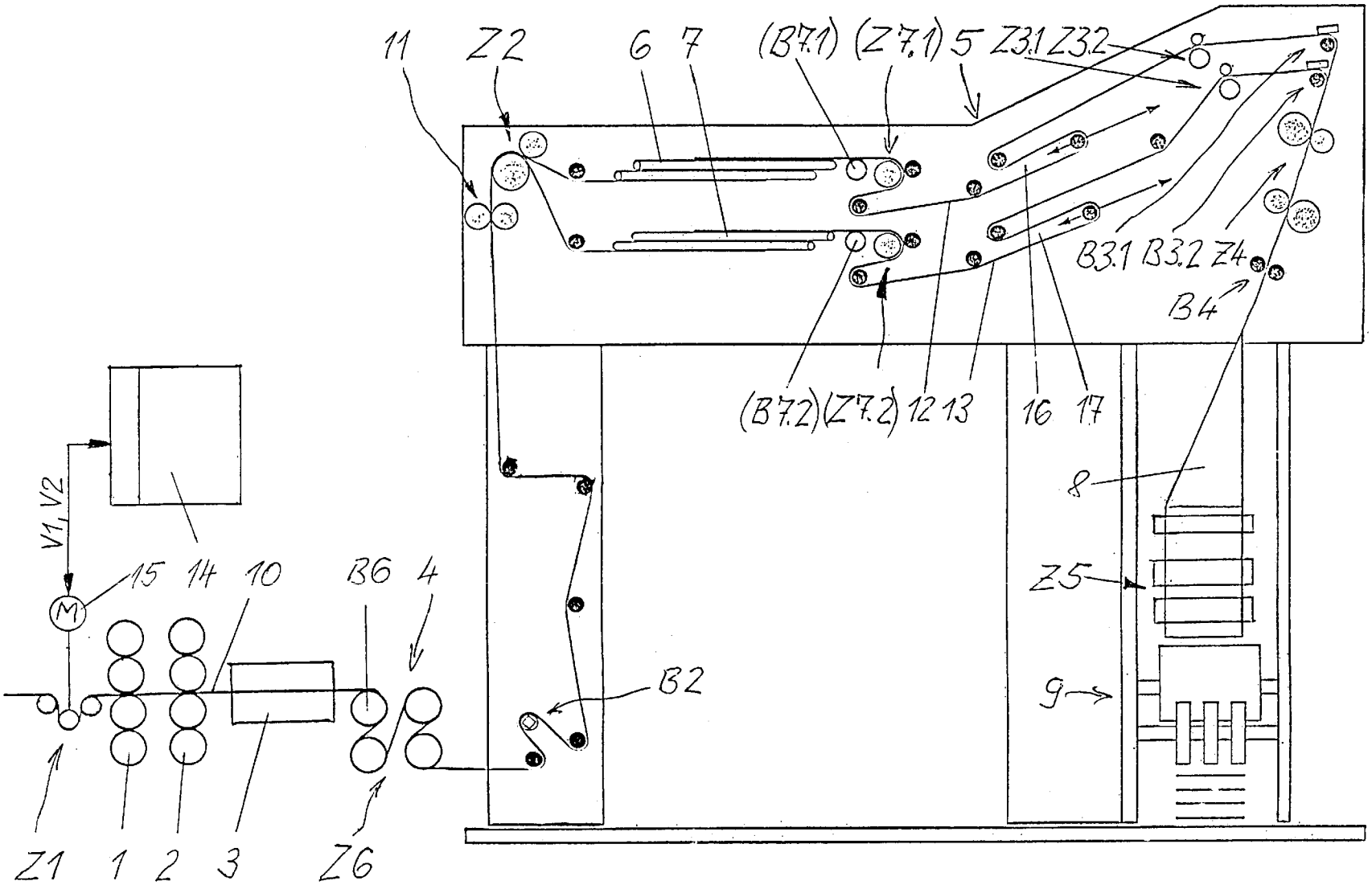
Z1
1
2
3
Z6
B6
4
B2
11
Z2
6
7
(B7.1) (Z7.1) 5
Z3.1 Z3.2
(B7.2) (Z7.2) 12 13
16 17
B3.1 B3.2 Z4
B4
8
Z5
9
14
15
10
V1, V2

METHOD OF OPERATING A WEB-FED ROTARY PRINTING MACHINE

BACKGROUND OF THE INVENTION

1. Field of the Invention

The invention relates to a method of operating a webfed rotary printing machine, for example, a newspaper printing machine or a publication printing machine.

2. Description of the Related Art

In such a printing machine, a web is printed by at least one printing unit and a number of web streams are guided above one another by means of turner bars and laid on one another and advance to a folding former, the web in its travel course passing through pull units the lead of which can be set.

It is barely possible for the operator to set the web tension in the folder superstructure of a printing machine, for the reasons cited below. Very often, adjustment facilities for the lead of pull units are not present. If the adjustment facility is present, the operator is displayed only the lead, which he cannot put into order, this display often being inaccurate, for example in the case of precision adjusting mechanisms.

If the operator then makes his settings in accordance with his visual impression in such a way that there are no creases in the folder superstructure, there is no incorrect run and the pins do not tear out, the leads can be set so unfavorably that, in the case of individual electrical drives, e.g., of the pull units, some drives exceed their rated torque but others are considerably underloaded.

If a number of web streams are taken over the folding former, the streams located on the inside can barely be influenced by other pull rolls. A generally recognized setting of the web tension—at the maximum at the former and less and less towards the outside—is thus impossible.

When the printing machine is being started up, the web tension dips considerable in the folder superstructure as a result of the influence of throwing the print on, damping solution, ink, silicone, in order then to recover again only slowly. If the dip is too sharp, the web runs off and paper breaks occur.

EP 0 908 310 A2 shows a device for feeding web streams to a folding former, each web stream being allocated a driven roll, over which the web streams are deflected individually and led to the former. The intention is in this way to avoid speed differences between the individual web streams, which are established when the streams, lying on one another, wrap around a pull roll.

SUMMARY OF THE INVENTION

It is an object of the invention to provide a method for achieving optimal web tension relationships in the folder superstructure.

According to the invention, the object of maintaining desired web tension values in the folder super structure is achieved by starting up the printing machine at a selected web speed and with print thrown off from the printing unit. Web pull units are disposed in the web course downstream of the printing unit and at locations in a folder superstructure and at a folding former. These pull units each have first and second drive lead values storable in a computing and memory unit. The pull units are operated at first drive lead values to provide optimal tensions in the web. The print is then thrown on in the printing unit and the pull units are operated at the second drive lead values to provide optimal tensions in the web.

Using the method, when the printing machine is started up, even in the case of different paper grades and productions, optimal gradations of the web tension are rapidly obtained on the former and in the entire folder superstructure. As a result, even web tension problems during a production change are eliminated. The method can be automated. Overall, rejects and machine down times (web breaks) can be reduced.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWING

In the drawing:

The FIGURE of drawing is a schematic showing of a publication printing machine with the web run as far as a folder.

DETAILED DESCRIPTION OF THE PRESENTLY PREFERRED EMBODIMENTS

The web-fed rotary printing machine shown in the FIGURE contains a number of printing units 1, 2, a drying oven 3, a cooling unit 4, a folder superstructure 5 with turner bars 6, 7, a folding former 8 and various rolls, and a folder 9.

A web 10, on the web path through the rotary printing machine, runs successively through a first pull unit Z1 upstream of the printing unit 1, a sixth pull unit Z6 embodied by the cooling unit 4, and a second pull unit Z2 upstream of the turner bars 6, 7. A slitting device 11 divides the web 10 into two web streams 12, 13, each of which passes through one of respective third pull devices Z3.1 and Z3.2. A fourth pull device Z4 is located upstream of the folding former 8, and a fifth pull device Z5 is located downstream of the folding former 8.

The web streams 12, 13, are guided above one another by means of the turner bars 6, 7 and laid on one another before the inlet to the folding former 8. As a special case, webs which have not been slit can also be guided to the folding former.

Also arranged on the web course are web tension measuring devices for measuring the web tension, to be specific a sixth web tension measuring device B6 in the cooling unit 4, a second web tension measuring device B2 upstream of the second pull unit Z2, in each case a third web tension measuring device B3.1 and B33.2 for the web streams 12 and 13 downstream of the third pull units Z3.1 and Z3.2, and a fourth web tension measuring device B4 downstream of the fourth pull unit Z4.

In addition, respective seventh pull units Z7.1 and Z7.2 can be arranged for each web stream 12, 13 downstream of the turner bars 6, 7, and seventh web tension measuring devices B7.1, and B7.2 can be arranged upstream of the seventh pull units Z7.1 and Z7.2. These items are only indicated in brackets, since they are not used in the exemplary embodiment. The pull units Z1 to Z7.2 are shown schematically. Their design may vary, that is to say they may operate with a large wrap and/or with a pressure roll, may comprise a number of pairs of rolls, and so on.

Likewise, the design of the web tension measuring devices B1 to B7.2 remains open, for example they may operate with strain gauges or pneumatically. The web streams 12, 13, also pass cut-register rolls 16, 17.

Each pull unit Z1 to Z7.2 has its own electric drive motor, referred to below as a drive. The lead of each drive can be set and, for this purpose, the drive is connected to a computing and storage unit 14. In order to maintain clarity, only the drive 15 of the pull unit Z1 is illustrated, and its connection to the computing and storage unit 14 shown. The computing and storage unit 14, in which lead values for the pull units Z1 to Z7.2 are storeable, is a constituent of the machine control system of the rotary printing machine which is familiar to those skilled in the art.

The method proceeds in such a way that, firstly, the web 10 is lead through the rotary printing machine with the print thrown off from the printing units 1, 2, that is to say as a white, unprinted web. In the process, the web 10 is pulled by the pull units Z1 to Z6, which are operated with first lead values V1 called up from the computing and memory unit 14.

The leads are advantageously referred to the circumferential speed of the printing units 1, 2. The leads may also be of a negative kind, that is to say there may also be retardations from case to case. The leads in each case have to be called up specifically for a specific paper grade and a specific web path, that is to say a specific production run.

For the case in which no lead values for the paper grade and production run to be carried out have yet been stored in the computing and memory unit 14, these are set or derived empirically during a test and production runs or at the start of production within the context of setting optimal web tensions. Setting is carried out in accordance with values based on experience and in accordance with the optical impression, in such a way that no creasing occurs in the folder superstructure, the web does not run off and the pins do not tear out.

Also advantageous is the presence of the third pull units Z3.1 and Z3.2 for the web streams 12 and 13, which means that a graduation of the web tensions can be set well, specifically in such a way that the web stream 12 subsequently lying on the folding former 8 has the higher web tension, and the web stream 13 located on the first has the lower web tension. The level of the web tensions themselves can be measured by means of the web tension measuring devices B3.1 and B3.2.

Once the web 10 is running with the desired web tension and the first leads V1 of the pull units Z1 to Z6, which may have been fixed for the first time for this purpose, as well as the web tensions, have been stored in the computing and memory unit 14, printing is switched on, i.e., the print is thrown on (changing the printing units 1, 2 over to print on), including the supply of ink and optionally, damping solution. In the process, at the web tension measuring devices B3.1 and B3.2 of the web streams 12, 13, a web tension and web tension gradation which differs from the transport of the white web (that is to say with the print thrown off) will be established.

The web tension will normally dip, irrespective of the fact that—as previously—the web tension of the first pull unit Z1 upstream of the printing unit 1 is increased when printing is switched on. For example, it is possible to operate at the pull unit Z1 with about 200 N with printing off and with about 500 N with printing on. The optimal values have to be determined by trials, also taking the web width into account.

Then, by means of "slow" web tension control at constant machine speed, the lead of the fourth pull unit Z4 upstream of the folding former 8 is adjusted until the original gradation of the web tensions of the web streams 12, 13 for white paper have been established again. The web tension downstream of the sixth pull unit Z6 is then brought to the value for white paper either by changing the lead of the sixth pull unit Z6 or of the second pull unit Z2 upstream of the turner bars. Which lead is adapted depends on the utilization of the drives.

If, for example, the sixth pull unit Z6 is loaded to 20% of the nominal power, and the second pull unit Z2 upstream of the turner bars 6, 7 is loaded to 80%, and if the web tension has to be increased, the lead of the fourth pull unit Z4 upstream of the folding former 8 and the fifth pull unit Z5 downstream of the folding former 8 are also increased to such an extent that 80% of the nominal power is not exceeded when increasing the lead of the drive of the second pull unit Z2. Once the web tension downstream of the sixth pull unit Z6 has been readjusted, any deviation in the web tension downstream of the folding former 8 is again balanced out by means of the fifth pull unit Z5. The actual values of the web tension downstream of the sixth pull unit Z6 and downstream of the fourth pull unit Z4 are each determined by means of the web tension measuring device B2 and B4, respectively.

The web tension measured values of all the web tension measuring devices B2 to B6, not illustrated for reasons of clarity, are fed to the computing and memory unit 14. There, the actual values of the web tensions are compared with desired values and, depending on the deviation, the pull units Z2 to Z6 that need adjustment, have their lead adjusted. Control loops of this type are familiar to those skilled in the arts.

The above-described readjustment of the web tensions in the folder superstructure is switched off as soon as the cut-register control is activated. The second lead values V2 obtained by means of the slow web tension control are written to memories in the computing and memory unit 14.

In the event of subsequent, repeated processing of the same paper grade, the stored second lead values V2 can be called up and predefined immediately printing starts. This also applies to the stored first lead values V1 when starting up the printing machine. For the case in which, after printing has been switched on, ink and, if appropriate, damping solution are connected up with a time offset, the above-described web tension readjustment remains in effect then as well.

In the event that about 80% of the rated drive power of the drive of a pull unit, for example the second pull unit Z2, is exceeded for longer than about 20 seconds, the lead of the pull units Z4 and Z5 downstream in the web running direction is increased in such a way that the drive power of the pull unit Z2 is below about 80%. This increase in the lead is also carried out with the cut-register control active. This measure avoids pull units being switched off as a result of overloading, with associated machine downtimes, or the destruction of overloaded drives. The lead values V1, V2 obtained in the process for the pull units Z2 to Z6 are written to the memory of the computing and memory unit 14, the previously stored respective lead values being overwritten. These lead values are specific for each of different ones of paper grades and machine production runs and are data empirically prior derived from tests and production runs.

The exemplary embodiment describes a rotary printing machine for publication printing. The method can likewise be applied to newspaper printing machines, the drying oven 3 and the cooling unit 4, together with the sixth pull unit Z6 and sixth web tension measuring device B6, then being dispensed with.

The method can also be applied if operations are carried out with a magazine folder, for example, instead of with the folder 9 shown.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. Method for maintaining desired web tension values in a web advancing through a rotary printing machine, the rotary printing machine including a printing unit for printing the web, turner bars downstream of the printing unit for guiding the web and any web stream divided from the web one above another through a folder superstructure, a folding former downstream of the turner bars to which the web and any web stream laid on one another pass, drive means for pulling the web and any web stream through the printing machine, the drive means including a plurality of pull units, each pull unit having first and second drive lead values storable in a computing and memory unit, the pull units including a first pull unit upstream of the printing unit, a second pull unit upstream of the turner bars, third pull units downstream of the turner bars, a fourth pull unit upstream of the folding former, a fifth pull unit downstream of the folding former, and optionally a sixth pull unit downstream of the printing unit and upstream of the second pull unit, said method comprising the steps of:

starting up the printing machine at a selected web speed and with print thrown off from the printing unit, and operating the second, third, fourth, fifth and sixth pull units at the first drive lead values of each of the pull units for providing optimal tensions in the web;

throwing the print on in the printing unit including ink and optionally damping solution; and operating the printing machine with the second, third, fourth, fifth and sixth pull units at the second drive lead values of each of the pull units for providing the optimal tensions in the web.

2. The method according to claim 1, wherein the storable first and second drive lead values of the pull units are specific for each of different ones of paper grades and machine production runs and comprise data empirically derived from prior tests and production runs.

3. The method according to claim 1, wherein the storable first drive lead values of the second, third, fourth, fifth and sixth pull units are specific for each of different ones of paper grades and machine production runs and comprise data empirically derived from prior tests and production runs.

4. The method according to claim 1, wherein the storable first and second drive lead values comprise data empirically derived from prior tests and production runs, derivation of the second drive lead values including, following the step of throwing on the print in the printing unit, the additional steps of:

adjusting a web tension of the web and any web stream produced with the fourth pull unit to an original web tension produced with the fourth pull unit during print thrown off operation, and adjusting a web tension of the web and any web stream produced between the fourth pull unit and the fifth pull unit to an original web tension produced between the fourth pull unit and the fifth pull unit during print thrown off operation by appropriately varying the drive lead value of the fifth pull unit, said additional steps being effected at a constant web speed, the adjustment of the web and any web stream being ended when a cut-register control in the folder superstructure is activated.

5. The method according to claim 4, wherein after adjusting web and any web stream tension with the fourth pull unit, a web tension between the sixth pull unit and the second pull unit is adjusted to an original web tension produced between the sixth pull unit and the second pull unit during print thrown off operation by appropriately varying the drive lead value of one of the sixth pull unit and the second pull unit.

6. The method according to claim 5, wherein upon about 80% of a rated drive power of a drive of the second pull unit being exceeded as the second drive lead value of the second pull unit increases, the second drive lead values of the fourth and fifth pull units are correspondingly increased.

7. The method according to claim 5, wherein upon about 80% of a rated drive power of a drive of the second pull unit being exceeded for more than about 20 seconds, drive lead values of pull units downstream and/or upstream of the second pull unit are increased such that power of the second pull unit is below about 80% of rated drive power, the increase being effected notwithstanding activation of the cut-register control.

8. The method according to claim 7, wherein the storable first and second drive lead values of the second, third, fourth fifth and sixth pull units are specific for each of different ones of paper grades and machine production runs and obtained by adjusting web tensions of a particular paper grade and production run are written to the memory unit for storage, the first and second dive lead values of the particular paper grade and production run being overwritten in the memory unit.

* * * * *